US006812899B2

(12) United States Patent
Moren et al.

(10) Patent No.: US 6,812,899 B2
(45) Date of Patent: Nov. 2, 2004

(54) ANTENNA ARRANGEMENT

(75) Inventors: Stefan Moren, Kista (SE); Minh Tri Nguyen, Kista (SE)

(73) Assignee: Allgon Mobile Communications AB, Akersberga (SE)

( * ) Notice: Subject to any disclaimer, the term of this patent is extended or adjusted under 35 U.S.C. 154(b) by 0 days.

(21) Appl. No.: 10/399,989

(22) PCT Filed: Mar. 28, 2002

(86) PCT No.: PCT/SE02/00630

§ 371 (c)(1),
(2), (4) Date: Sep. 26, 2003

(87) PCT Pub. No.: WO02/080304

PCT Pub. Date: Oct. 10, 2002

(65) Prior Publication Data

US 2004/0051673 A1 Mar. 18, 2004

(30) Foreign Application Priority Data

Apr. 2, 2001 (SE) ..... 0101172

(51) Int. Cl.[7] ..... H01Q 1/24
(52) U.S. Cl. ..... 343/702; 343/906
(58) Field of Search ..... 343/702, 906, 343/873, 700 MS; H01Q 1/24

(56) References Cited

U.S. PATENT DOCUMENTS 6,577,280 B2 * 6/2003 Kim ..... 343/702
6,597,319 B2 * 7/2003 Meng et al. ..... 343/702
6,661,380 B1 * 12/2003 Bancroft et al. ..... 343/700 MS

FOREIGN PATENT DOCUMENTS

| | | |
|---|---|---|
| FR | 2736214 | 1/1997 |
| JP | 7-312515 | 11/1995 |
| JP | 9-260933 | 10/1997 |
| SE | 514486 | 3/2001 |
| SE | 9903482-9 | 3/2001 |
| WO | WO01/24311 | 4/2001 |

* cited by examiner

*Primary Examiner*—Hoanganh Le
(74) *Attorney, Agent, or Firm*—Jacobson Holman PLLC

(57) ABSTRACT

The present invention provides an antenna arrangement for a portable radio communication device, allowing a flexible design. This is achieved by using axially resilient connection devices (3) that are positioned in apertures (4) in a support structure (2) for an antenna element (1). The present invention further provides a method for performing a flexible design of such an antenna arrangement.

8 Claims, 7 Drawing Sheets

FIG. 11
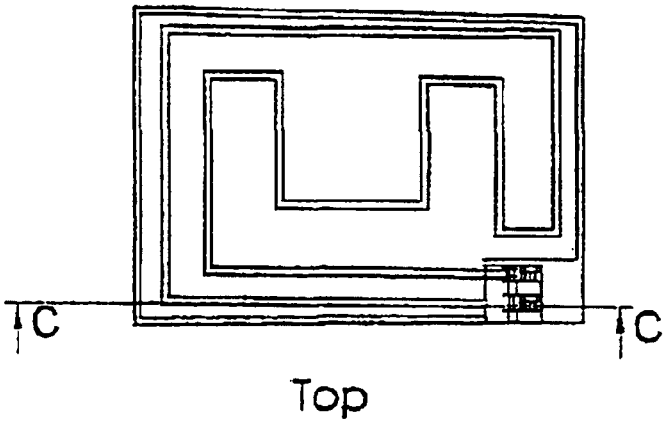
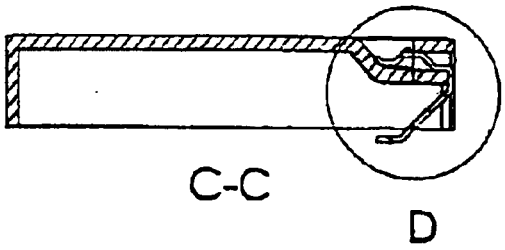
FIG. 12
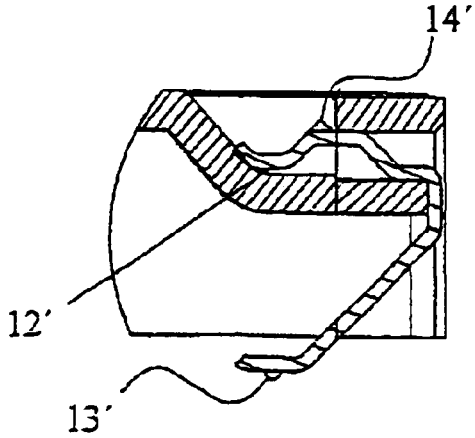
FIG. 13

ANTENNA ARRANGEMENT

This is a nationalization of PCT/SE02/00630 filed Mar. 28, 2002 and published in English.

FIELD OF INVENTION

The present invention generally relates to an antenna arrangement for a portable radio communication device. More particularly it relates to an antenna element including a connection portion for connection to RF circuitry in a portable radio communication device by means of a connection device.

BACKGROUND

There are many known ways to mount and electrically connect an antenna of a portable radio communication device, such as a mobile phone, to the RF part of the internal electronic arrangement. With very large production volumes, several million antennas or more, the cheapest possible components are usually selected, as small differences in manufacturing price results in large differences in manufacturing cost.

A great deal of both time and money are spent to obtain the cheapest possible solution of an antenna arrangement.

With moderate production volumes, up to a few million antennas, the largest cost reductions are possible to obtain during development of new production lines.

One known way to mount and electrically connect a patch antenna in a high frequency device is to provide a patch electrode through a dielectric and thereafter soldering the patch electrode to the patch antenna.

Soldering of connection electrodes involves both drawbacks and advantages. One drawback with soldering is that the high temperature used puts high demands on components exposed to such high temperature. One advantage is that the connection electrode is securely fixed in its position.

SUMMARY OF THE INVENTION

An object of the present invention is to provide an antenna arrangement that is easily adapted to new configurations.

This object, among others, is attained by an antenna arrangement, a portable radio communication device and a method as defined in the appended claims.

By providing an axially resilient connection device the radial forces necessary to secure the connection device in an aperture is reduced, whereby soldering of the connection device may be passed over.

By providing a planar surface in an aperture for receiving a connection portion of an antenna element the connection portion is more easily folded into the aperture.

By providing a rounded surface on a connection device a well defined yet smooth connection may be obtained between the connection device and a connection portion of an antenna element.

Further features and advantages of the present invention will be evident from the following description.

BRIEF DESCRIPTION OF THE DRAWINGS

The present invention will become more fully understood from the detailed description of embodiments given below and the accompanying figures, which are given by way of illustration only, and thus, are not limitative of the present invention, wherein:

FIG. 11 shows a connection device according to the fifth embodiment of the present invention;

FIG. 12 shows a top view and a cut along the line C—C of the fifth embodiment of the present invention;

FIG. 13 shows blown up portion of the area D shown in FIG. 12;

DETAILED DESCRIPTION OF EMBODIMENTS

Figure 1:
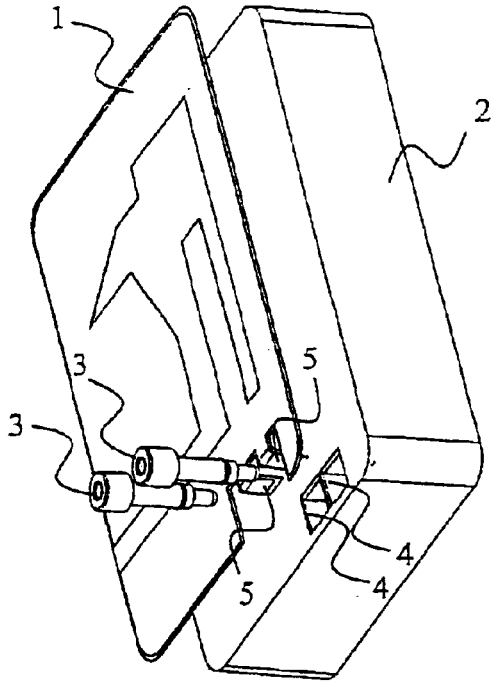
FIG. 1 shows an exploded view of an antenna arrangement according to a first embodiment of the present invention.
Figure 2:
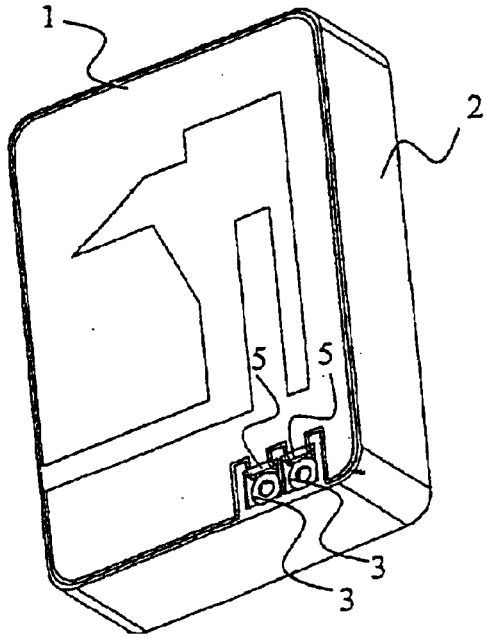
FIG. 2 shows the antenna arrangement in FIG. 1 in a non-exploded view.
Figure 3:
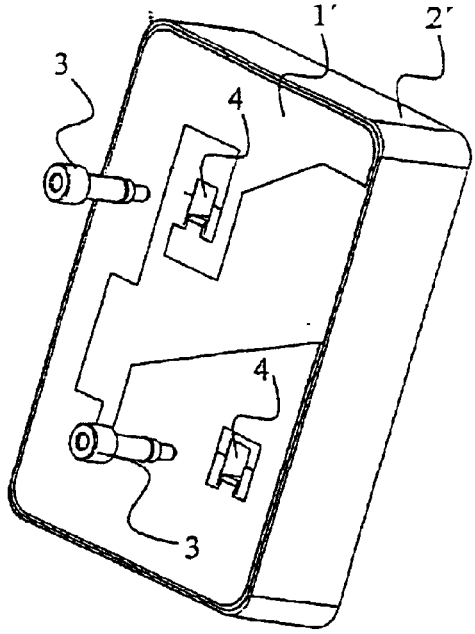
FIG. 3 shows an exploded view of an antenna arrangement according to a second embodiment of the present invention.
Figure 4:
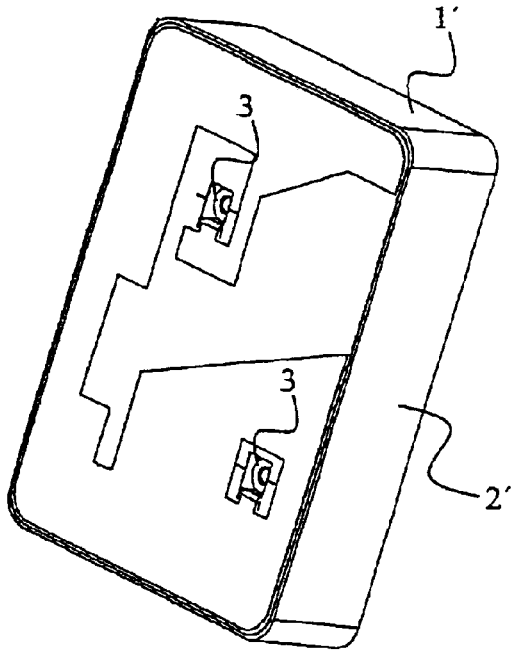
FIG. 4 shows the antenna arrangement in FIG. 3 in a non-exploded view.

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

A first embodiment of the present invention will now be described with reference to FIGS. 1, 2 and 14–16.

An antenna module comprises a flexible antenna element 1, such as a flex film, and a support structure 2 for support of the flex film. The flex film includes two tongues 5; one for feeding the antenna and one for grounding the antenna.

The support structure 2 includes two apertures 4 for receiving the two tongues 5. The antenna module further comprises two connection devices 3, wherein each has a longitudinal axis, such as PoGo™ pins, for connecting the flex film to RF circuitry and grounding portions of a portable radio communication device, such as a mobile telephone. The two apertures 4 are further for receiving the two connection devices 3.

Next one connection device 3 and one corresponding aperture 4 will be described. The connection device 3 is arranged to fixate one tongue 5 in the aperture 4 by means of radial forces. An end of the connection device 3 fixates the tongue 5 in the aperture and electrically connects to it. This end of the connection device is of uniform thickness along a length corresponding to the length the tongue 5 that extends down into the aperture 4. The other end of the connection device 3 is axially resilient, for connection to a PCB (Printed Circuit Board) of the mobile telephone, either for connection to RF circuitry or to ground. Due to the axial resilience of the connection device 3 the radial forces necessary to prevent axial displacement of the connection device is greatly reduced.

Figure 17:
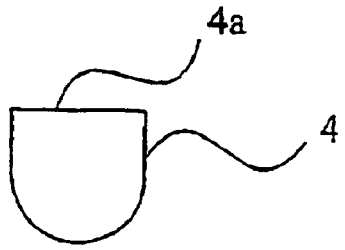
FIGS. 17–19 shows a cross-section of another aperture according to the present invention.
Figure 15:
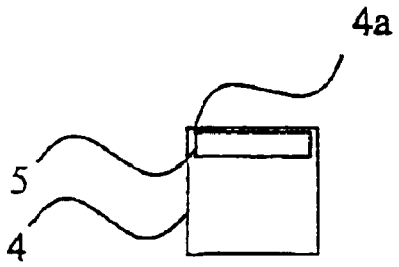
Figure 18:
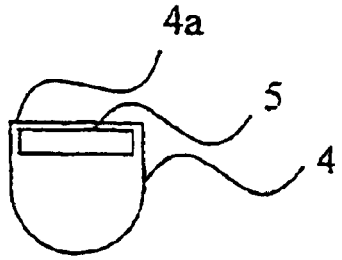
Figure 16:
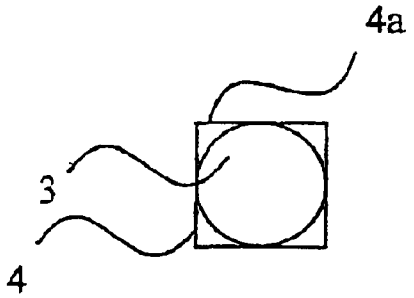
Figure 19:
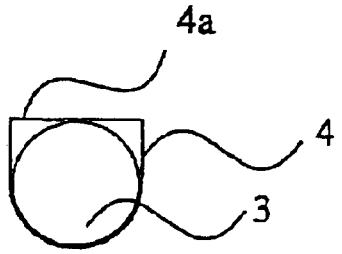

The aperture 4 has a square shaped cross-section, such that at least the side 4*a* receiving the connection tongue 5 is planar. Further, the connection device 3 has a circularly shaped cross-section, such that at least the portion connecting the connection tongue 5 has a rounded surface. The aperture 4 may alternatively have a cross-section shaped e.g. as illustrated in FIGS. 17–19. With a circular cross-section of the connection device 3 and the alternatively shaped aperture 4 a rounded surface press against the connection tongue 5 and a rounded surface press against a correspondingly rounded surface of the alternatively shaped aperture 4.

The antenna module is by the above-described configuration easily adapted to requirements on the space an antenna module may occupy in a housing of a mobile telephone and contact positions where to contact RF circuitry and grounding portions on a PCB in the mobile telephone. The support structure 2 is easily adapted to fit a specific volume. The apertures 4 are easily provided in the support structure 2 in connection with the contact positions on the PCB. The flex film 1 is mounted to the support structure 2. The connection tongues 5 are positioned in the apertures 4. The connection devices 3 are positioned in the apertures 4, fixating the connection tongues 5 in the apertures 4 and electrically connects thereto. A stopper may be provided in the aperture 4, to facilitate mounting of a connection device 3. Alternatively, the connection tongue 5 may be positioned above the aperture 4, to be positioned in the aperture 4 by the positioning of the connection device 3 into the aperture 4.

The antenna module is then ready to be positioned in the housing of the mobile telephone. It is not necessary to know the exact distance between the support structure 2 and the contact positions on the PCB as the connection devices 3 are axially resilient. The axial resilience further lowers the needed radial forces to maintain the connection devices 3 in its respective aperture 4.

A second embodiment of the present invention will now be described with reference to FIGS. 3, 4 and 14–16.

An antenna module comprises a flexible antenna element 1', such as a flex film, and a support structure 2' for support of the flex film. The flex film includes two tongues; one for feeding the antenna and one for grounding the antenna.

The support structure 2' includes two apertures 4 for receiving a respective tongue. The antenna module further comprises two connection devices 3, wherein each has a longitudinal axis, such as PoGo™ pins, for connecting the flex film to RF circuitry and grounding portions of a portable radio communication device, such as a mobile telephone. The two apertures 4 are further for receiving a connection device 3 each.

Each respective connection device 3 is arranged to fixate a respective tongue in a respective aperture 4, by means of radial forces. One end of a connection device 3 fixates a respective tongue in an aperture 4 and electrically connects to it. This end of the connection device is of uniform thickness along a length corresponding to the length a tongue 5 extending down into the aperture 4. The other end of the connection device 3 is axially resilient, for connection to a PCB of the mobile telephone.

Each aperture 4 has a square-shaped. cross-section, such that at least the side 4*a* receiving the connection tongue 5 is planar. Each connection device 3 has circularly shaped cross-section, such that at least the portion connecting the connection tongue 5 has a rounded surface. An aperture 4 may alternatively have a cross-section shaped as illustrated in FIGS. 17–19. With a circular cross-section of the connection device 3 and the alternatively shaped aperture 4 a rounded surface press against the connection tongue 5 and a rounded surface press against a correspondingly rounded surface of the alternatively shaped aperture 4.

The contact positions on the PCB are different from the contact positions of the first embodiment, resulting from a different configuration of the antenna element and/or from different positions of RF and ground positions on the PCB of the mobile telephone.

The antenna module is by the above-described configuration easily adapted to requirements on the space an antenna module may occupy in a housing of a mobile telephone and contact positions where to contact RF circuitry on a PCB in the mobile telephone. The support structure 2 is easily adapted to fit a specific volume. The apertures 4 are easily provided in the support structure 2 in connection with the contact positions on the PCB. The flex film 1 is mounted to the support structure 2. The connection tongues 5 are positioned in the apertures 4. The connection devices 3 are positioned in the apertures 4, fixating the connection tongues 5 in the apertures 4. A stopper may be provided in the aperture 4, to facilitate mounting of a connection device 3.

The antenna module is then ready to be positioned in the housing of the mobile telephone. It is not necessary to know the exact distance between the support structure 2 and the contact positions on the PCB as the connection devices 3 are axially resilient. Further, the axial resilience lowers the needed radial forces to maintain the connection devices 3 in its respective the aperture 4.

Figure 5:
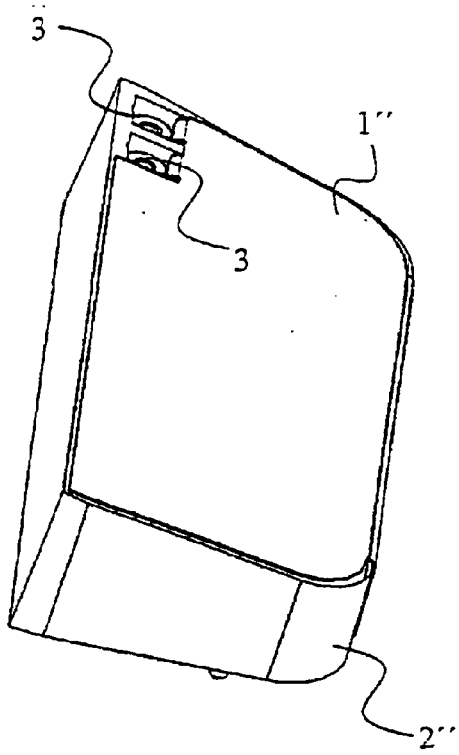
FIG. 5 shows an antenna arrangement according to a third embodiment of the present invention.
Figure 6:
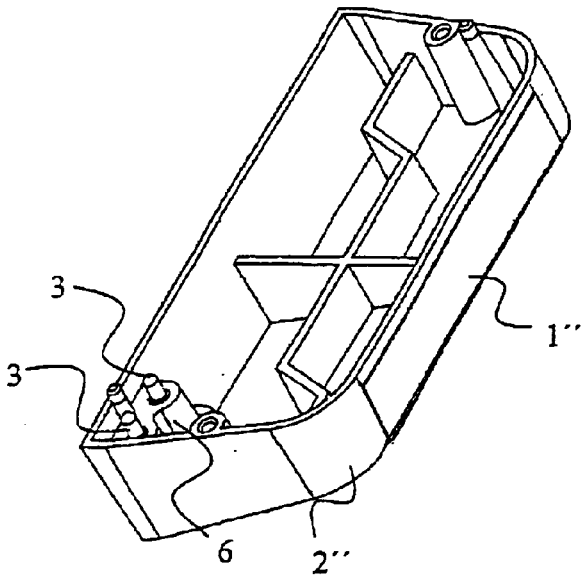
FIG. 6 shows the antenna arrangement in FIG. 5 viewed from below.

A third embodiment of the present invention will now be described with reference to FIGS. 5 and 6.

An antenna module comprises a flexible antenna element 1", such as a flex film, a support structure 2" for support of the flex film. The flex film includes two tongues; one for feeding the antenna and one for grounding the antenna.

The support structure 2" includes two apertures for receiving the two tongues. The two apertures are surrounded by a supportive stoper 6. The antenna module further comprises two connection devices 3, each having a longitudinal axis, such as PoGo™ pins, for connecting the flex film to RF circuitry and grounding portions of a portable radio communication device, such as a mobile telephone. The two apertures are further for receiving the two connection devices 3.

Each respective connection device 3 is arranged to fixate a respective tongue in a respective aperture, by means of radial forces. One end of a connection device 3 fixates a respective tongue in an aperture and electrically connects to it. The other end of each connection device 3 is axially resilient, for connection to a PCB of the mobile telephone. Each stopper 6, uniform with the support 2", includes a land to maintain a connection device 3 received therein. The axially resilient part of the connection device 3 protrudes past the land towards the contact positions on the PCB.

The contact positions on the PCB are different from the contact positions of the first and second embodiments, resulting from a different configuration of the antenna element.

The antenna module is by the above-described configuration easily adapted to requirements on the space the antenna module may occupy in a housing of a mobile telephone and contact positions where to contact RF circuitry on a PCB in the mobile telephone. The support structure 2 is easily adapted to fit a specific volume. The apertures 4 are easily provided in the support structure 2 in connection with the contact positions on the PCB. The flex film 1 is mounted to the support structure 2. The connection tongues 5 are positioned in the apertures 4. The connection devices 3 are positioned in the apertures 4, fixating the connection tongues 5 in the apertures 4.

The antenna module is then ready to be positioned in the housing of the mobile telephone. It is not necessary to know the exact distance between the support structure 2 and the contact positions on the PCB as the connection devices 3 are axially resilient. Further, the axial resilience lowers the needed radial forces to maintain the connection devices in its respective aperture.

A fourth embodiment of the present invention will next be described with reference to FIGS. 7–9.

Figure 7:
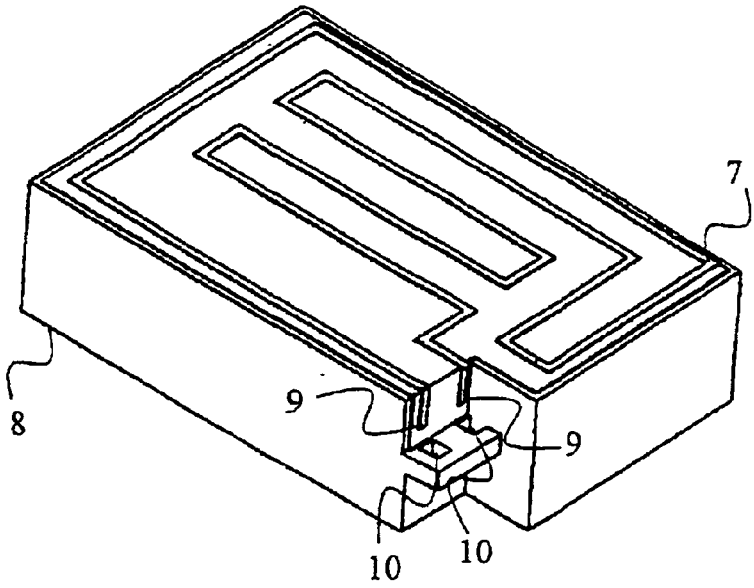
FIG. 7 shows an antenna arrangement according to a fourth embodiment of the present invention.

An antenna module, as shown in FIG. 7, comprises an antenna element 7, formed as a meander, and a support structure 8 for support of the flex film. The meander antenna 7 includes two tongues 9; one for feeding the antenna and one for grounding the antenna.

Figure 8:
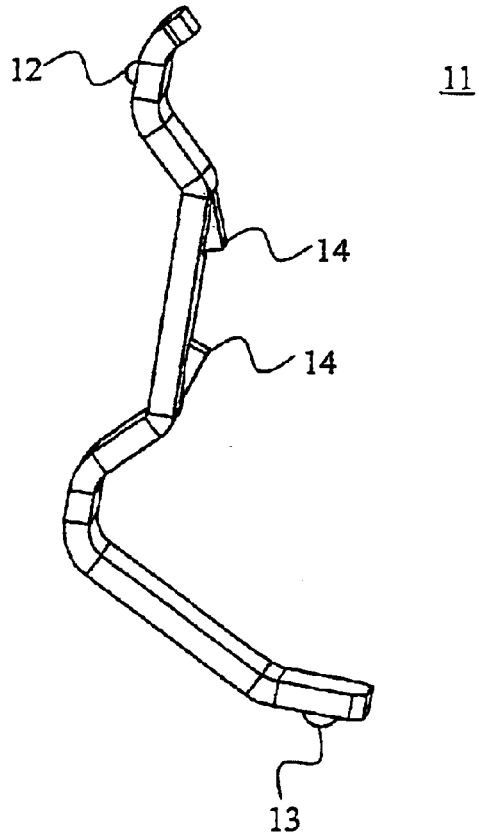
FIG. 8 shows a connection device according to the fourth embodiment of the present invention.

The support structure 8 includes two holes 10 for receiving a respective connection device 11, as shown in FIG. 8, each having a longitudinal axis. The two connection devices 11 are provided for connecting the meander antenna element 7 to RF circuitry and grounding portions of a portable radio communication device, such as a mobile telephone.

Each respective connection device 11 is arranged to fixate a respective tongue 9 of the meander antenna element 7 to the support structure 8 and to be connectable to a PCB of the mobile telephone, by means of radial forces. A protruding contact point 12 at one end of the connection device 11 fixates the respective tongue 9 to the support structure 8 and electrically connects to it. The other end of the connection device 11 is axially resilient, for connection to the PCB of the mobile telephone, comprising a protruding contact point 13 for electrical connection to the mobile telephone.

Figure 9:
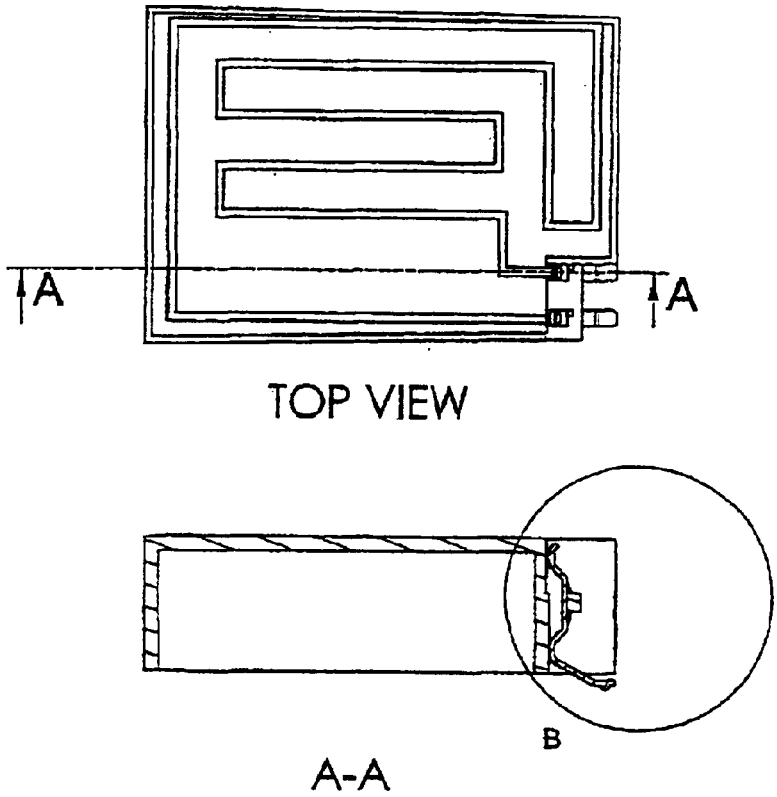
FIG. 9 shows a top view and a cut along the line A—A of the fourth embodiment of the present invention.

The connection device 11 further comprises two hooks 14 for locking the connection device 11 to the hole 10, which is illustrated in FIG. 9.

A fifth embodiment of the present invention will next be described with reference to FIGS. 10–13.

Figure 10:
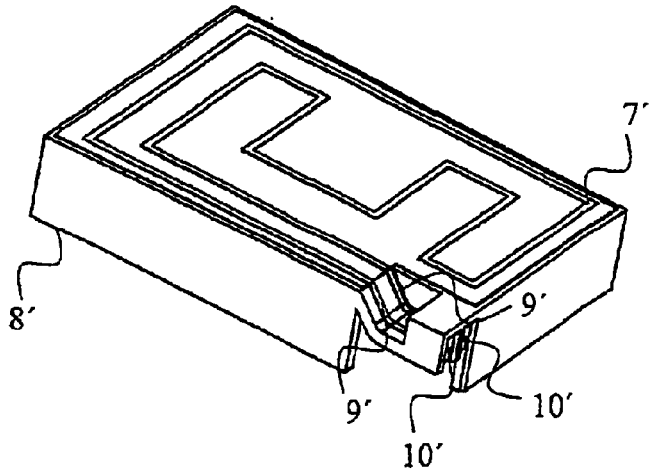
FIG. 10 shows an antenna arrangement according to a fifth embodiment of the present invention.
Figure 14:
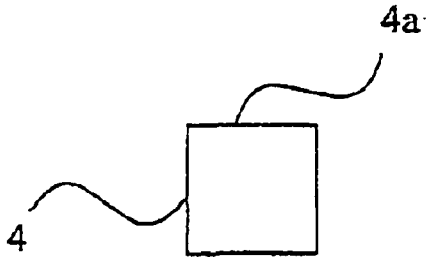
FIGS. 14–16 shows a cross-section of an aperture according to the present invention.

An antenna module, as shown in FIG. 10, comprises an antenna element 7', formed as a meander, and a support structure 8' for support of the meander antenna element 7'. The meander antenna element 7' includes two tongues 9'; one for feeding the antenna and one for grounding the antenna.

The support structure 8' includes two holes 10' for receiving a respective connection device 11', as shown in FIG. 11. The two connection devices 11' are provided for connecting the antenna element 7' to RF circuitry and grounding portions of a portable radio communication device, such as a mobile telephone.

Each respective connection device 11' is arranged to fixate a respective tongue 9' to the support structure 8' and to be connectable to a PCB of the mobile telephone. A protruding contact point 12' at one end of the connection device 11' fixates the respective tongue 9' to the support structure 8' and electrically connects to it. The other end of the connection device 11' is resilient, for connection to the PCB of the mobile telephone, comprising a protruding contact point 13' for electrical connection to the mobile telephone.

The connection device 11' further comprises a hook 14' for locking the connection device 11' to the hole 10', which is illustrated in FIG. 12 and blow up in FIG. 13.

In the above described embodiments different positions of the apertures or holes (i.e. the contact positions on the PCB) have resulted in different configurations of the antenna element. Each embodiment of the present invention may of course adapt the configuration of the antenna element in dependence on desired radiation. characteristics. The configuration of the antenna element includes the number of connection tongues, which may vary from one to as many as desired. For each connection tongue a corresponding aperture, or hole, and connection device are provided.

The above used term flex film, should be interpreted as a flexible and thin material comprising conductive portions such as wires or bands.

It will be obvious that the present invention may be varied in a plurality of ways. Such variations are not to be regarded as departure from the scope of the present invention. All such variations as would be obvious for a person skilled in the art are intended to be included within the scope of the present invention.

What is claimed is:

1. An antenna arrangement for a portable radio communication device including RF circuitry, said antenna arrangement comprising:

an antenna element comprising a connection portion;

a support structure supporting said antenna element and comprising at least one aperture; and a connection device for connecting said antenna element to the RFE circuitry of the portable radio communication device, wherein said connection device has a longitudinal axis and is positioned in said at least one aperture; wherein said connection device fixates said connection portion to said support structure and electrically connects said connection portion to said connection device by means of radial forces;

said connection device is axially resilient for connection to said RF circuitry; and said aperture has a planar portion for receiving said connection portion.

2. The antenna arrangement as claimed in claim 1, wherein said connection device has a circular cross-section for a smooth fixation and connection to said connection portion.

3. The antenna arrangement as claimed in claim 1, wherein said antenna element is flexible.

4. The antenna arrangement as claimed in claim 3, wherein said flexible antenna element is a flex film.

5. The antenna arrangement as claimed in claim 1, comprising a stopper for defining a mounting position of said connection device.

6. The antenna arrangement as claimed in claim 1, wherein said connection device comprises a hook for locking said connection device into said aperture.

7. A portable radio communication device, comprising an antenna arrangement as claimed in claim 1.

8. A method for manufacturing an antenna arrangement for a portable radio communication device including RF circuitry, said antenna arrangement comprising: an antenna element including a connection portion; a support structure supporting said antenna element and comprising at least one aperture; and a connection device for connecting said antenna element to the RF circuitry of the portable radio communication device, wherein said connection device has a longitudinal axis is positioned in said at least one aperture; wherein said connection device fixates said connection portion to said support structure and electrically connects said connection portion to said connection device by means of radial forces; said connection device is axially resilient for connection to said RE circuitry; and said aperture has a planar portion for receiving said connection portion; and wherein said method comprises the following steps:

forming said support structure to fit into a predetermined volume inside the portable radio communication device;

forming said at least one aperture in said support structure in alignment with a contact area on a PCB of the portable radio communication device;

attaching said antenna element to said support structure, wherein said connection portion is positioned above the aperture;

bringing said connection device into said aperture, and thereby fixating said connection portion and said connection device in said aperture.

* * * * *